US011828424B2

(12) United States Patent
Scholz

(10) Patent No.: US 11,828,424 B2
(45) Date of Patent: Nov. 28, 2023

(54) TORCH

(71) Applicant: Ledlenser GmbH & Co. KG, Solingen (DE)

(72) Inventor: Ulrich Scholz, Ratingen (DE)

(73) Assignee: Ledlenser GmbH & Co. KG, Solingen (DE)

( * ) Notice: Subject to any disclaimer, the term of this patent is extended or adjusted under 35 U.S.C. 154(b) by 0 days.

(21) Appl. No.: 17/789,564

(22) PCT Filed: Mar. 1, 2021

(86) PCT No.: PCT/DE2021/100200
§ 371 (c)(1),
(2) Date: Jun. 28, 2022

(87) PCT Pub. No.: WO2021/190691
PCT Pub. Date: Sep. 30, 2021

(65) Prior Publication Data

US 2023/0036086 A1 Feb. 2, 2023

(30) Foreign Application Priority Data

Mar. 25, 2020 (DE) ..... 10 2020 108 165.0

(51) Int. Cl.
*F21L 4/00* (2006.01)
*F21V 23/04* (2006.01)

(52) U.S. Cl.
CPC ..... *F21L 4/005* (2013.01); *F21V 23/04* (2013.01)

(58) Field of Classification Search
CPC ..... F21L 4/005; F21L 23/04
See application file for complete search history.

(56) References Cited

U.S. PATENT DOCUMENTS 4,152,755 A 5/1979 Nixt et al.
4,458,299 A * 7/1984 Stephens ..... F21L 2/00 362/267

(Continued)

FOREIGN PATENT DOCUMENTS

DE 60132597 T2 1/2009
DE 202010009881 U1 10/2010

(Continued)

OTHER PUBLICATIONS

English translation of Vomberg, DE-202010009881-U1, published Nov. 2010 (Year: 2010).*

*Primary Examiner* — Evan P Dzierzynski
(74) *Attorney, Agent, or Firm* — McGlew and Tuttle, P.C.

(57) ABSTRACT

A torch (1), which is producible at low cost and is operable comfortably with one hand, irrespective of a gripping position, includes a torch head (2) which has a lighting unit (18), including a housing (3) configured as a gripping piece that extends along a longitudinal axis (L) and has a closed end section (4) at the rear. A linear-travel switch with a slide (5) operates the torch (1). The slide (5) is slidably and captively mounted on the housing (3). The slide (5) is formed in an L-shape with a first section (6) and a second section (9). The first section (6) extends longitudinally and axially along the housing (3) and the second section (9) engages behind (or catches behind) the closed end section (4) of the housing (3), so that the linear-travel switch can be operated in different gripping positions.

16 Claims, 3 Drawing Sheets

(A-A)

(56) References Cited

U.S. PATENT DOCUMENTS

| | | | | |
|---|---|---|---|---|
| 2010/0177508 | A1* | 7/2010 | Maglica | F21V 31/03 362/183 |
| 2016/0368463 | A1* | 12/2016 | Opatrny | B60S 3/044 |
| 2018/0194021 | A1* | 7/2018 | Nguyen | B26B 1/08 |
| 2019/0063696 | A1* | 2/2019 | Grandadam | H05B 47/175 |

FOREIGN PATENT DOCUMENTS

| | | | | |
|---|---|---|---|---|
| DE | 202010009881 | U1 * | 11/2010 | F21L 4/085 |
| DE | 202019104630 | U1 | 10/2019 | |
| WO | 2012010126 | A2 | 1/2012 | |

* cited by examiner

TORCH

CROSS REFERENCE TO RELATED APPLICATIONS

This application is a United States National Phase Application of International Application PCT/DE2021/100200, filed Mar. 1, 2021, and claims the benefit of priority under 35 U.S.C. § 119 of German Application 10 2020 108 165.0, filed Mar. 25, 2020, the entire contents of which are incorporated herein by reference.

TECHNICAL FIELD

The present invention relates to a torch (also known as a flashlight) having a torch head, which comprises a lighting unit, a housing, which is designed as a handle piece, extends along a longitudinal axis and comprises a closed end portion to the rear, and a push switch, which comprises a slider for operating the torch, the slider being captively mounted on the housing so as to be slidable.

TECHNICAL BACKGROUND

Cylindrical torches which can be operated in various ways are known from the prior art, the operation being adapted to the preferred grip position or hold when the torch is used in the intended manner. A distinction can be drawn here between the standard grip position and the so-called tactical grip position.

In the standard grip position, the torch is positioned in the hand in such a way that the front portion of the torch rests with the torch head mostly between the thumb and index finger. Such torches have a switch which is located in the front region of the torch and is operated with the thumb. The switch in this case can be designed as a push switch or pressure switch. Such a torch is disclosed for example in DE 20 2010 009 881 U1.

In the tactical grip position, which is preferred in particular by emergency personnel, the torch is held rotated through 180°, so that the portion of the torch with the torch head leaves the closed hand in the region of the side of the hand, i.e. largely between the little finger and the ball of the thumb. Such torches usually have a pressure switch which is mounted in the end portion of the housing, preferably within an end cap, and is likewise operated with the thumb. A torch having such an end cap switch is described in WO 2012/010126 A2, for example.

The torches known from the prior art are disadvantageous because in each case they can only be comfortably used single-handedly in one particular grip position. If the torch is not held in the intended grip position, it has to be rotated through 180° in order to operate it, or the other hand must be used to operate the switch. While it is true that torches having two separate, functionally identical switches are known, such torches are complicated to manufacture and thus expensive, because two separate switch mechanisms with a corresponding wired connection have to be provided and installed.

SUMMARY

The problem addressed by the present invention is therefore that of producing a torch which can be comfortably used single-handedly, regardless of the grip position, and yet is economical to produce.

This problem is solved by the torch according to the invention. The invention provides that the slider is L-shaped in configuration, with a first portion and a second portion, the first portion extending longitudinally-axially along the housing and the second portion engaging behind the closed end portion of the housing, so that the push switch can be operated in different grip positions. In this way, the torch can be used in both the standard and the tactical grip position, single-handedly, comfortably, and without the need to reach around it awkwardly. In the standard grip position, the thumb rests on the first portion of the slider, so that the torch can be operated by moving the slider in a longitudinally-axial manner. In the tactical grip position, the thumb rests on the second portion of the slider, which can thus be operated in the same way as a pressure switch or touch switch on an end cap switch. Despite the flexible operability of such a torch, only one switching mechanism is required; this reduces the costs of a torch according to the invention in comparison with torches that have two separate but functionally identical switches in different positions.

Preferred embodiments of the present invention are described below.

According to a first embodiment of the invention, it is provided that, to operate the push switch, the slider can be moved against the force of a spring, wherein the spring is preferably configured as a compression spring and is mounted between the front face of the end portion of the housing and the second portion of the slider. The spring-loaded mounting of the slider prevents the torch from being switched on or off accidentally.

For the captive mounting of the slider, it is preferably provided that the first portion thereof engages at the front in a cylindrical receiver in the torch head and/or the second portion thereof has guide elements with guide faces and snap-in hooks, which engage in an undercut receiver on the rear end portion of the housing.

In the context of a further advantageous development of the invention, it is provided that in a portion between the contact face and the rear end portion of the housing, the slider is partially covered and in this portion runs inside a guide channel in the housing. In this way it is possible to operate the slider smoothly and without obstruction, even when the torch is held very firmly.

According to a particularly preferred embodiment of the invention, it is provided that the torch has a magnetic switch, to which end a magnet-sensitive sensor is arranged in the torch head or in the housing of the torch in such a way that, by means of a sliding movement of the slider, the magnet-sensitive sensor can be brought into operative connection with a magnet element, which is connected to the slider. It is preferably provided that the magnet element is arranged in a portion of the slider which engages in the cylindrical receiver in the torch head. As an alternative to such a magnetic switch, the switch can also be configured as a mechanical pressure switch or touch switch. To this end, a touch switch or pressure switch can likewise be arranged in the cylindrical receiver in the torch head, wherein a rubber membrane is arranged between the touch switch and the slider to protect the interior of the housing against dust, dirt and water.

Finally, it is provided according to a preferred embodiment of the invention that the slider has a ball spring and the ball runs along an approach ramp when the slider is operated. The ball spring is preferably arranged in a ball spring receiver in the slider. Through the chosen form of the approach ramp and the spring force of the ball spring, the haptic feel when the push switch is operated can be adjusted in such a way that the operator can sense or feel at any time where the slider is in relation to the housing of the torch and how far the slider still needs to be pushed in order to operate the torch.

Such a torch can essentially be made from any materials, such as plastic and/or aluminum, for example, wherein the slider and the torch housing can if necessary also be made from different materials.

A specific embodiment of the present invention is explained below by reference to the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiment of the invention are illustrated.

BRIEF DESCRIPTION OF THE DRAWINGS

In the drawings:

FIG. 1*b* is a cross-sectional representation of the torch according to FIG. 1*a;*

FIG. 2*b* is a cross-sectional representation of the torch according to FIG. 2*a;*

FIG. 3*b* is a cross-sectional representation of the torch according to FIG. 3*a.*

DESCRIPTION OF PREFERRED EMBODIMENTS

Figure 1A:
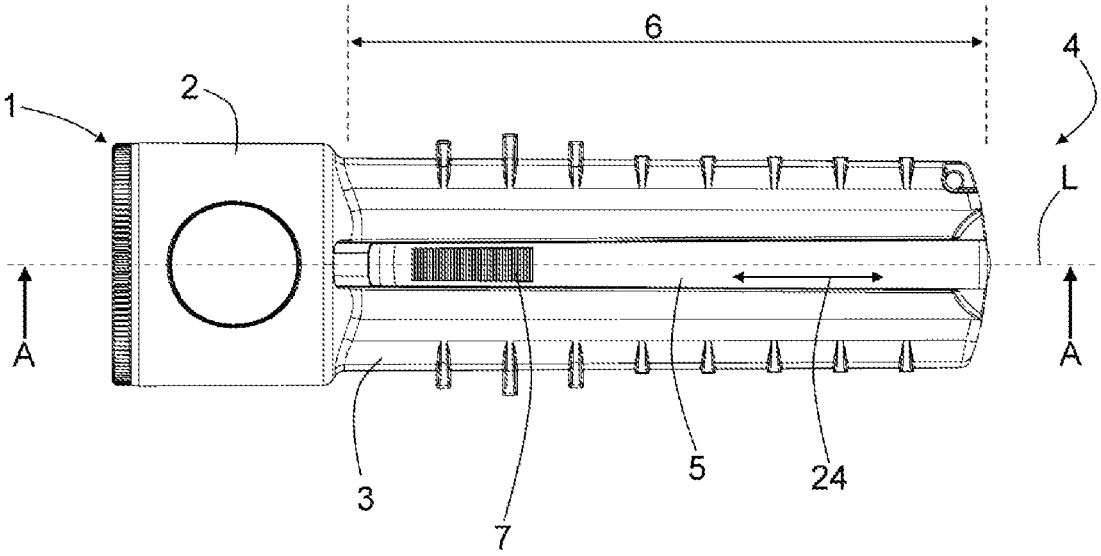
FIG. 1*a* is a plan view of a torch.
Figure 1A:
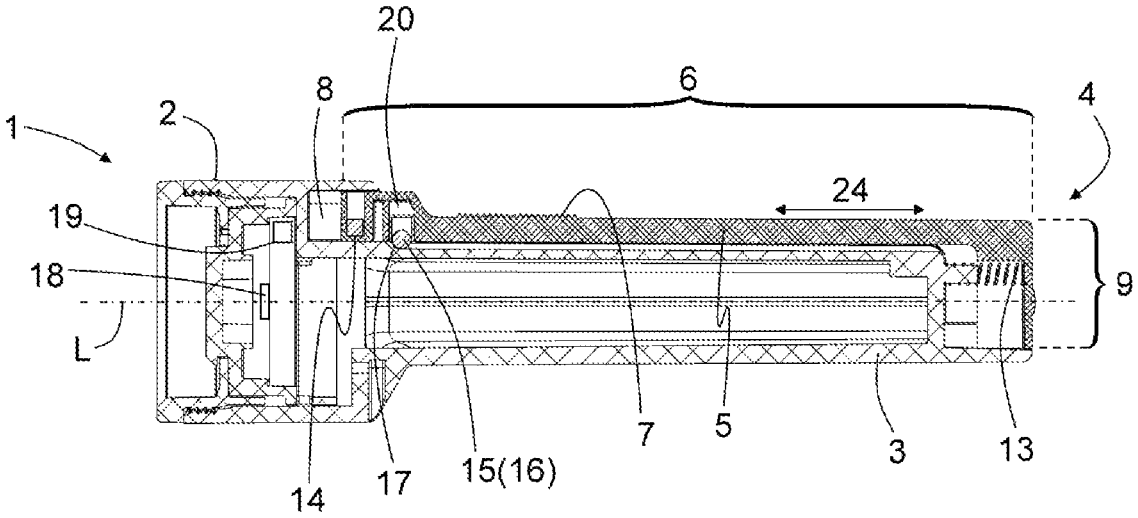

Referring to the drawings, FIG. 1*a* shows a specific embodiment of the torch (flashlight) 1 according to the invention in a perspective plan view. The torch 1 has a torch head 2 with a lighting unit 18 (FIG. 1*b*). The torch head 2 is connected to a housing 3, which is configured as a handle piece and extends along a longitudinal axis L. The housing 3 has a closed end portion 4 to the rear. To operate the torch 1, there is provided a push switch with a slider 5, which is captively mounted on the housing 3 so as to be slidable in the arrow direction 24, the sliding ability of the slider 5 being limited by means of a front and a rear stop. To enable the slider 5 to be operated in both the standard and the tactical grip position, the slider 5 is L-shaped in configuration and has firstly a first portion 6, which extends longitudinally-axially along the housing 3. In FIG. 1*a*, this first portion 6 of the slider 5 is shown in a plan view, wherein the slider 5 has, in the front region, a roughened contact face 7 for operation with the thumb in the standard grip position.

FIG. 1*b* shows a cross-sectional representation of the torch 1 along the cross-sectional planes A-A, in which the L-shaped configuration of the slider 5 is visible. The captive mounting of the slider 5 is ensured in that it initially engages on the housing 3 with the first portion 6 of the slider 5 at least partly in a cylindrical receiver 8 in the torch head 2. At the rear end of the torch 1, the slider 5 has a second portion 9, which is oriented substantially perpendicularly to the first portion 6 and engages behind the closed end portion 4 of the housing 3. This second portion 9 serves to operate the torch 1 in the tactical grip position and can be pressed using the thumb. In the embodiment shown, the slider 5 is mounted so as to be slidable against the force of a compression spring 13, the compression spring 13 being positioned between the rear end portion 4 of the housing 3 and the second portion 9 of the slider 5. In the region of the first portion 6 of the slider 5, the slider 5 has as a signal transmitter a magnet element 14, which, by sliding the slider 5, can be brought into operative contact with a magnet-sensitive sensor 19 as a signal receiver, positioned in the torch head 2, in order to operate the torch 1. The slider 5 also has a ball spring 15, which is mounted inside a cylindrical ball spring receiver 20 in the slider 5, wherein when the slider 5 is operated, the ball 16 of the ball spring 15 runs along an approach ramp 17, which is formed on the housing 3 of the torch 1.

Figure 2A:
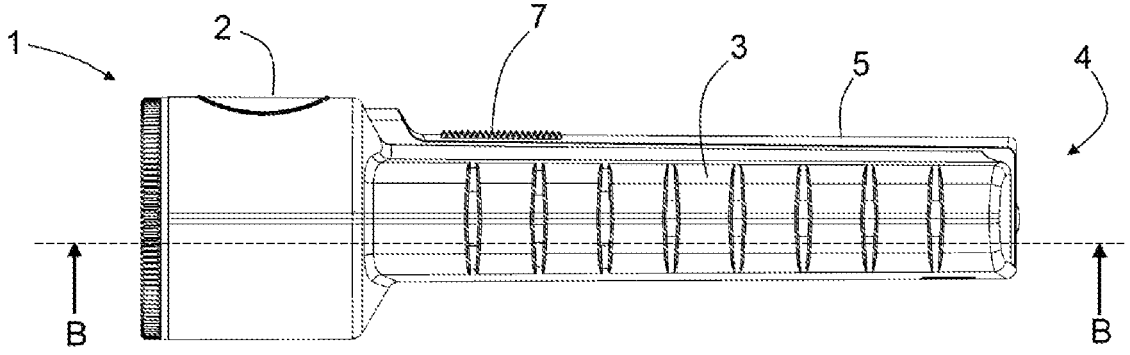
FIG. 2*a* is a side view of a torch.
Figure 2A:
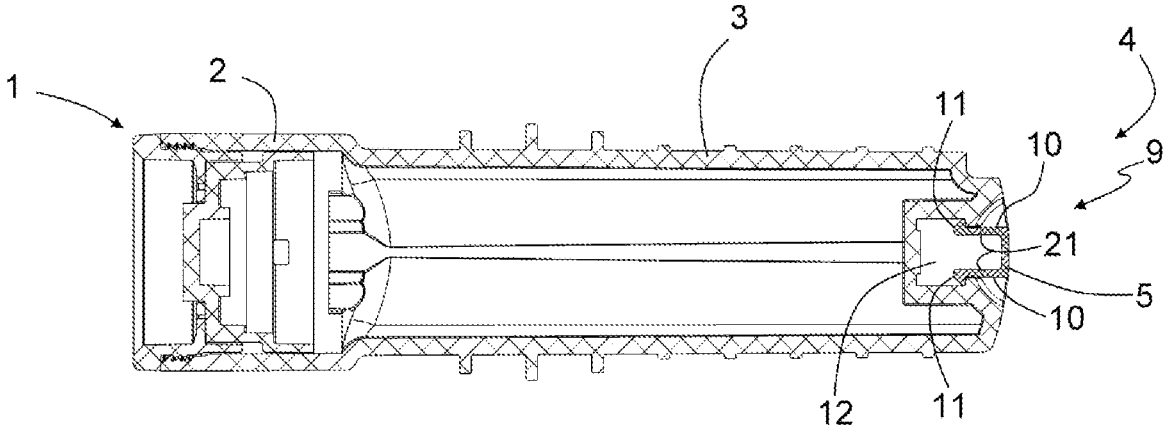

FIG. 2*a* shows the torch 1 according to FIGS. 1*a* and 1*b* in a perspective side view. FIG. 2*b* shows a cross-sectional representation along the eccentrically arranged cross-sectional planes B-B. According to this representation, the captive mounting of the slider 5 is further ensured in that the slider 5 additionally has two spaced-apart guide elements 21 with guide faces 10 and snap-in hooks 11, which engage in an undercut receiver 12 on the rear end portion 4 of the housing 3.

Figure 3A:
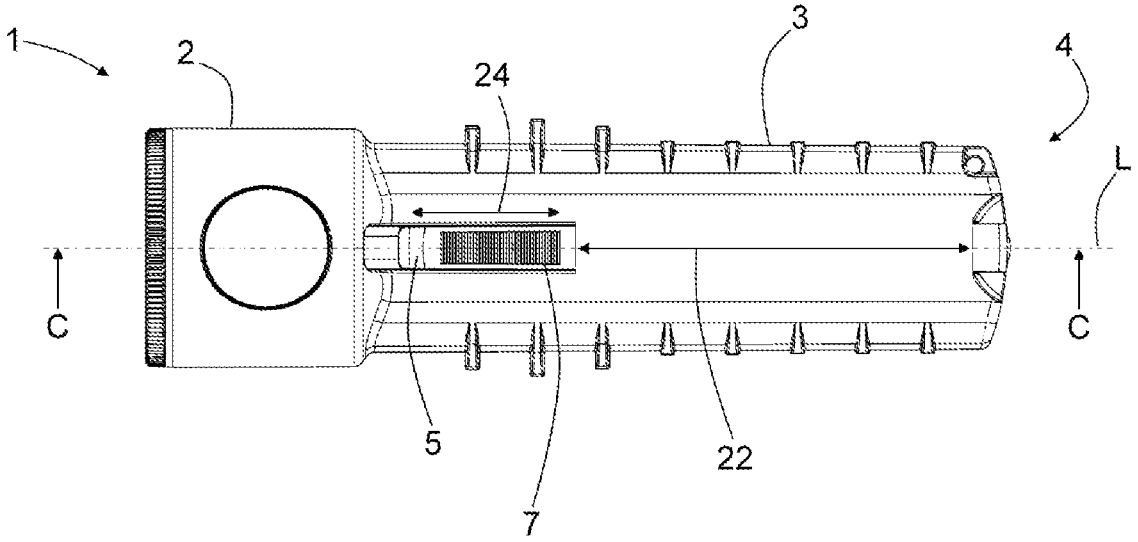
FIG. 3*a* is a plan view of a torch.
Figure 3A:
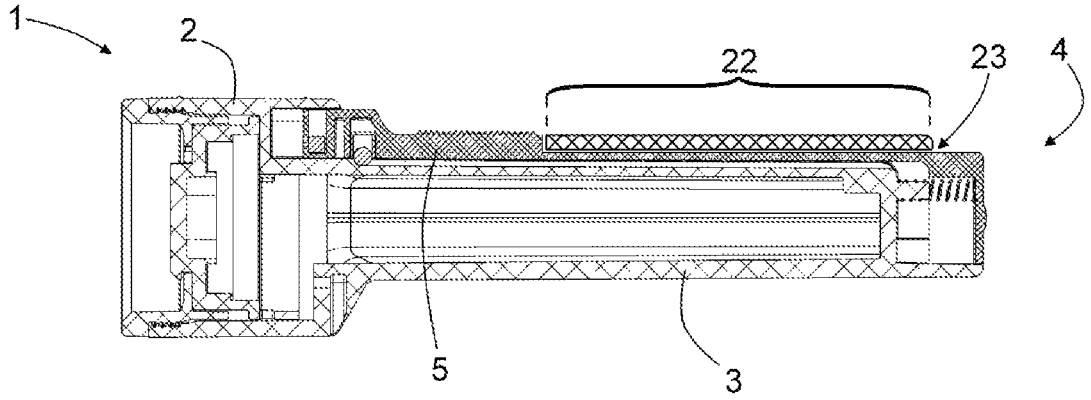

FIGS. 3*a* and 3*b* show a further specific embodiment of a torch 1 according to the invention, in which in a portion 22 between the contact face 7 and the rear end portion 4 of the housing 3, the slider 5 is partially covered. In this portion 22 the slider 5 runs inside a guide channel 23 in the housing 3, which means that it is possible to operate the slider 5 smoothly and without obstruction, in both the standard and the tactical grip position, even when the torch 1 is held very firmly.

While specific embodiments of the invention have been shown and described in detail to illustrate the application of the principles of the invention, it will be understood that the invention may be embodied otherwise without departing from such principles.

REFERENCE SIGNS

1 Torch (Flashlight)
2 Torch head
3 Housing
4 End portion
5 Slider
6 First portion
7 Contact face
8 Cylindrical receiver
9 Second portion
10 Guide face
11 Snap-in hooks
12 Receiver
13 Compression spring
14 Magnet element
15 Ball spring
16 Ball
17 Approach ramp
18 Lighting unit
19 Magnet-sensitive sensor
20 Ball spring receiver
21 Guide elements
22 Portion (with partially covered slider)
23 Guide channel
24 Arrow direction
L Longitudinal axis

The invention claimed is:

1. A torch, comprising a torch head, which comprises a lighting unit, a housing, which is configured designed as a handle piece, that extends along a longitudinal axis and comprises a closed end portion to the rear, and a push switch, which in order to operate the torch comprises a slider, wherein the slider is captively mounted on the housing so as to be slidable, wherein the slider is L-shaped in configuration, with a first portion and a second portion, the first portion extending longitudinally-axially along the housing and the second portion engaging behind the closed end portion of the housing, so that the push switch can be operated in different grip positions.

2. The torch according to claim 1, further comprising a spring, wherein, to operate the push switch, the slider is configured to be moved against a force of the spring.

3. The torch according to claim 2, wherein the spring is configured as a compression spring and is mounted between the front face of the end portion of the housing and the second portion of the slider.

4. The torch according to claim 2, wherein, for the captive mounting of the slider, at least one of:

the first portion engages in a cylindrical receiver in the torch head; and the second portion comprises guide elements with guide faces and snap-in hooks, which engage in an undercut receiver on the rear end portion of the housing.

5. The torch according to claim 2, wherein in a portion of the housing, between a contact face and the end portion, the slider is partially covered and in said portion of the housing the slider runs within a guide channel in the housing.

6. The torch according to claim 2, wherein the push switch is configured as a magnetic switch, comprising a magnet element and a magnet-sensitive sensor arranged in the torch head or in the housing such that, by means of a sliding movement of the slider, the magnet-sensitive sensor is brought into operative connection with the magnet element, which is connected to the slider.

7. The torch according to claim 6, wherein the magnet element is arranged in a portion of the slider which engages in the torch head.

8. The torch according to claim 2, wherein the slider comprises a ball spring and a ball, wherein the ball runs along an approach ramp with operation of the slider.

9. The torch according to claim 1 claim 1, wherein, for the captive mounting of the slider, the first portion thereof engages at a front in a cylindrical receiver in the torch head and/or the second portion thereof comprises guide elements with guide faces and snap-in hooks, which engage in an undercut receiver on the end portion of the housing.

10. The torch according to claim 9, wherein in a portion of the housing, between a contact face and the end portion, the slider is partially covered and in said portion of the housing the slider runs within a guide channel in the housing.

11. The torch according to claim 9, wherein the push switch is configured as a magnetic switch, comprising a magnet element and a magnet-sensitive sensor arranged in the torch head or in the housing such that, by means of a sliding movement of the slider, the magnet-sensitive sensor is brought into operative connection with the magnet element, which is connected to the slider.

12. The torch according to claim 11, wherein the magnet element is arranged in a portion of the slider which engages in the cylindrical receiver in the torch head.

13. The torch according to claim 1, wherein in a portion of the housing, between a contact face and the end portion of the housing the slider is partially covered and in said portion of the housing, the slider runs within a guide channel in the housing.

14. The torch according to claim 1, wherein the push switch is configured as a magnetic switch, which comprises a magnet element and a magnet-sensitive sensor arranged in the torch head or in the housing such that, by means of a sliding movement of the slider, the magnet-sensitive sensor is brought into operative connection with the magnet element, which is connected to the slider.

15. The torch according to claim 14, wherein the magnet element is arranged in a portion of the slider in the torch head.

16. The torch according to claim 1, wherein the slider comprises a ball spring and ball, wherein the ball runs along an approach ramp when the slider is operated.

* * * * *